United States Patent [19]

Larson et al.

[11] 3,985,634

[45] Oct. 12, 1976

[54] ELECTROLYTIC SILVER RECOVERY APPARATUS

[76] Inventors: Kay R. Larson, 1550 Columbia Ave., Pomona, Calif. 91766; John Drew, 541 40th St., Richmond, Calif. 94805; Howard Ott, 124 Old Mill Road, Great Neck, N.Y. 11023

[22] Filed: Jan. 27, 1975

[21] Appl. No.: 544,210

[52] U.S. Cl. ..... 204/212; 204/260; 204/261; 204/272; 204/273; 96/61 R

[51] Int. Cl.[2] ..... C25C 1/20; C25C 7/00; C25C 7/02; C25C 7/08

[58] Field of Search ..... 204/109–111, 204/272, 212, 216–218, 260, 261; 96/61 R

[56] References Cited

UNITED STATES PATENTS

| | | | |
|---|---|---|---|
| 899,226 | 9/1908 | Lutz | 204/272 |
| 3,464,910 | 9/1969 | Krebs et al. | 204/219 |
| 3,715,299 | 2/1973 | Anderson et al. | 204/212 |
| 3,827,962 | 8/1974 | Ahmad | 204/212 |

FOREIGN PATENTS OR APPLICATIONS

| | | | |
|---|---|---|---|
| 654,401 | 12/1962 | Canada | 204/109 |
| 916,438 | 1/1963 | United Kingdom | 204/272 |
| 1,123,168 | 8/1968 | United Kingdom | 204/272 |

OTHER PUBLICATIONS

Electroforming by Spiro, pp. 80, 81, 92, published by Robert Draper Ltd., Teddington (1971).

*Primary Examiner*—F.C. Edmundson
*Attorney, Agent, or Firm*—John H. Crowe

[57] ABSTRACT

Apparatus for elctrolytically removing silver from a spent photographic processing solution. A thin flexible cathode sheet is removably fitted within the inside periphery of a tank which receives the solution. A lid unit is removably secured over the tank and rotatably supports an anode assembly extending within the tank. A power unit is removably secured on the lid unit and carries a motor for driving the anode assembly to circulate the solution. An electric power conducting circuit in the power unit is automatically connected to the anode assembly and the cathode when the power unit is secured.

18 Claims, 7 Drawing Figures

ELECTROLYTIC SILVER RECOVERY APPARATUS

BACKGROUND OF THE INVENTION

1. Field of the Invention

This invention relates to electrolytic removal of metal from solutions, and has particular reference to the recovery of silver from exhausted photographic film processing solutions by an electrolytic process wherein an electric current is passed between anode and cathode electrodes immersed in the solution to cause the silver to be removed from the solution and deposited on the cathode.

2. Discussion of the Prior Art

It is common practice to recover silver from exhausted photographic processing solutions. The greatest amount of silver is recovered from photographic fixing solutions which contain either sodium thiosulfate or ammonium thiosulfate, and most of the prior art silver recovery systems of the electrolytic type employ means to continuously rotate or otherwise move the cathode through the solution at a rapid rate to reduce the concentration of sodium ions so that they will not cause decomposition of the thiosulfate, which decomposition would cause the formation of unwanted silver sulfide.

Although such prior systems are generally satisfactory, the silver does not always build up evenly over the surface of the cathode, and this results in an unbalanced condition which tends to cause wobbling or vibration as the cathode is rotated. Also, as the recovered silver builds up on the cathode, the loading on its bearings increases. Moreover, after a certain amount of silver has been built up, it must be stripped from the cathode by chipping, or otherwise cutting the same, so that the cathode may be re-used. This is tedious and time-consuming.

Attempts have been made to overcome the above problems by rotating the anode and maintaining the cathode stationary. However, in those systems of which applicants are aware, the cathode or cathodes are in the form of solid bars or plates, from which the silver must be stripped.

In addition, prior silver recovery systems generally require considerable dismantling in order to periodically remove the silver from the cathode. This is not only time-consuming, but during the dismantling there is a tendency for some of the corrosive and stain-producing solution to splash or spill onto the floor and other surrounding areas.

SUMMARY OF THE INVENTION

According to the present invention, a thin, inexpensive and disposable sheet of electro-conductive material, which is immune to the corrosive action of the solution, is employed as a cathode. Such sheet, which is pliable and easily flexed, is mounted on the inner periphery of the tank for receiving the exhausted photographic processing solution.

A lid unit is removably and hermetically sealed over the tank by means of a quick-disconnect clamp and rotatably supports an anode assembly within the tank. The anodes are in the form of paddles which, when rotated, create considerable circulation of solution over the surface of the cathode.

Quick-disconnect hose attachments are connected to the lid unit to convey photographic processing solution to and from the tank. A power drive unit is provided for rotating the anode assembly and for supplying current to the anode assembly and cathode. The drive unit is removably attached to the lid unit by quick-disconnect clamps.

Since the cathode sheet substantially covers the inner periphery of the tank, a maximum cathode area is provided for a given volume of solution. Thus, the apparatus may be made small enough to be conveniently handled by one person, even when completely filled with solution. For example, applicants have found that a 7½gallon solution receiving tank having a 10-inch inside diameter will adequately remove the silver from the photographic fixing solutions of most photographic film processing plants. Applicants' apparatus, furthermore, lends itself to easy and rapid servicing for replacement of the cathode when the latter is loaded with silver. To this end, the power unit may be readily removed from the lid unit to automatically disconnect the power supply circuit from the anode and cathode — while leaving the lid unit hermetically sealed over the tank. Accordingly, when the inlet and outlet fluid connections for the solution are sealed, the combined tank and lid assembly may be handled or transported without the possibility of spilling any of the solution.

This construction lends itself admirably to the servicing program in cases where the apparatus is installed in a film processing plant to receive the photographic processing solution as it passes from the film processing equipment. Here, a service man will periodically bring an empty replacement tank and attached lid assembly to the plant and transfer the power unit to the replacement tank and lid assembly, then remove the original tank and lid assembly with the silver-laden cathode therein to a suitable work area without danger of spilling the solution in the tank. At such location, the service man can safely discharge the solution from the tank, remove the silver-laden cathode, and install a new cathode sheet.

Accordingly, a principal object of the present invention is to provide an inexpensive, compact and yet highly efficient electrolytic silver recovery apparatus.

Another object is to provide an inexpensive disposable cathode for an electrolytic silver recovery apparatus.

Another object is to provide a maximum cathode surface for the tank of an electrolytic silver recovery apparatus.

Another object is to facilitate servicing of an electrolytic silver recovery apparatus.

A further object is to provide an improved shaft seal for an electrolytic silver recovery apparatus.

Figure 1:
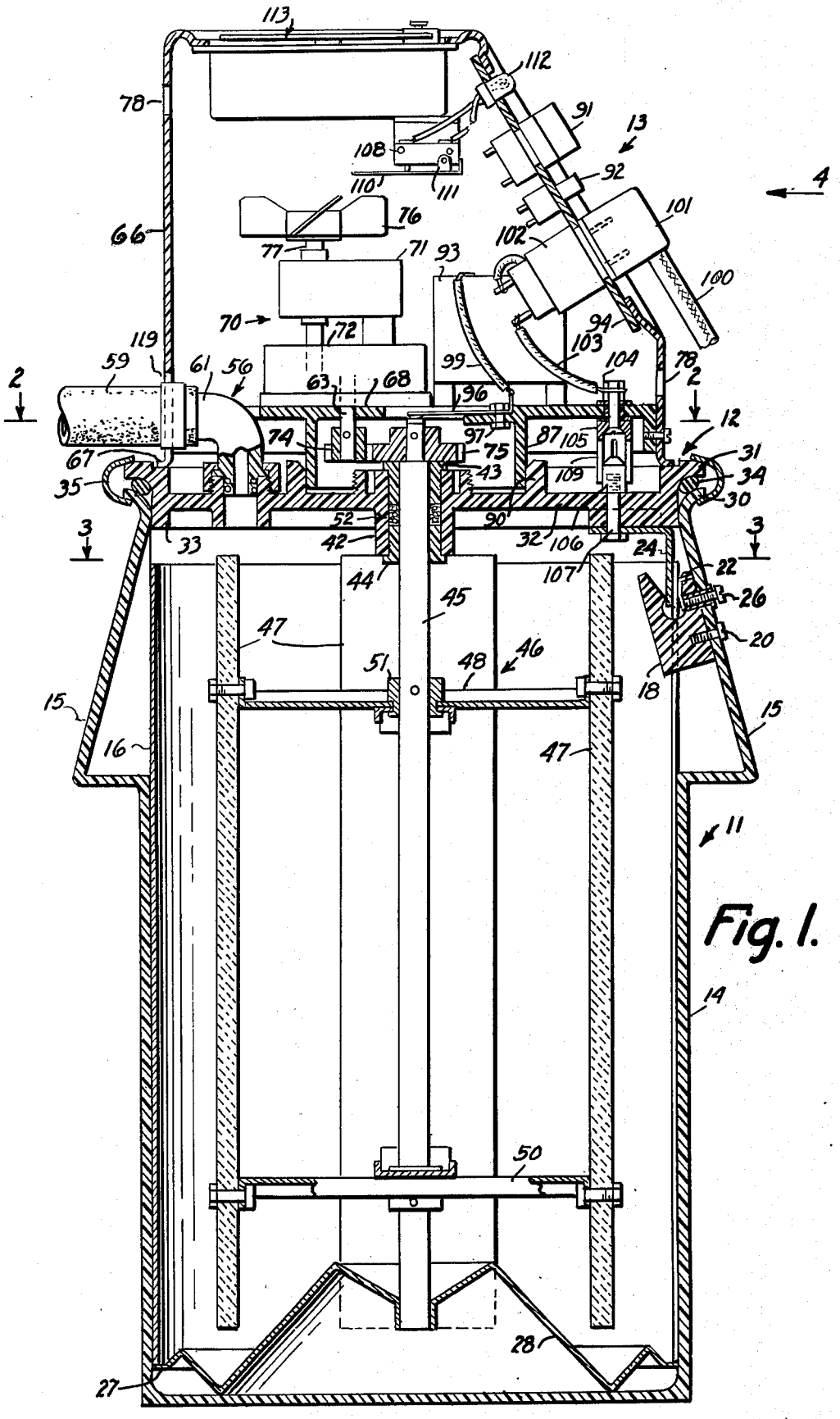
FIG. 1 is a sectional elevational view of an electrolytic silver recovery apparatus embodying a preferred form of the present invention.

DESCRIPTION OF THE PREFERRED EMBODIMENT:

Referring to the drawings, the silver recovery apparatus comprises in general a tank unit 11, a lid 12 removably attached and hermetically sealed to the tank unit, and a power unit 13 removably attached to the lid unit 12.

Tank unit 11 comprises a generally cylindrical tank 14 formed of plastic, such a polypropylene, which is impervious to chemical attack by any photographic processing solutions which may be introduced into the tank. A pair of diametrically opposed handle sections 15 are formed in the upper end of the tank to facilitate handling and transporting of the apparatus.

Figure 3:
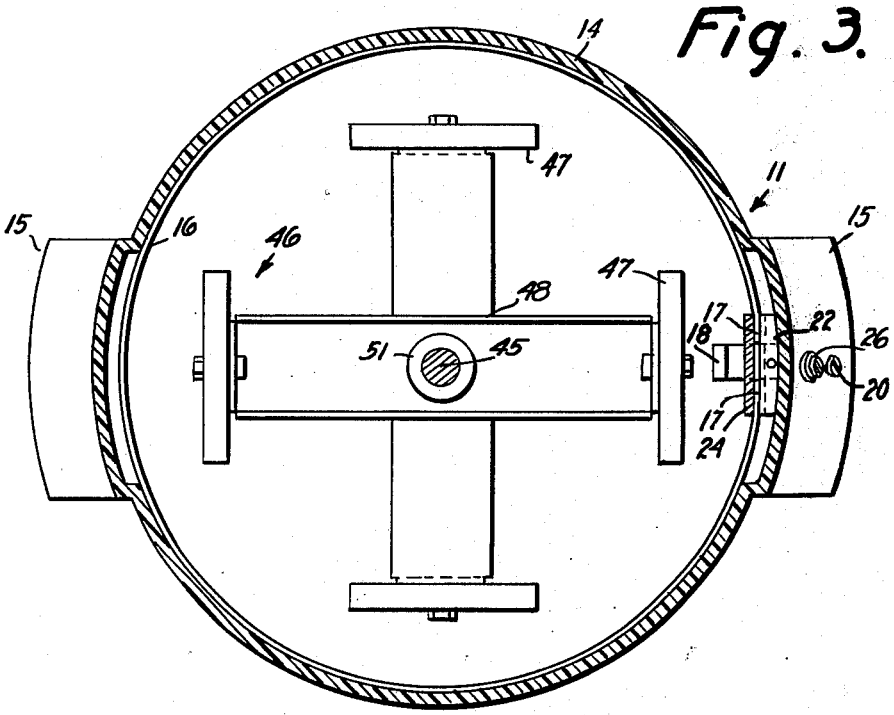
FIG. 3 is a sectional plan view taken along line 3—3 of FIG. 1.
Figure 7:
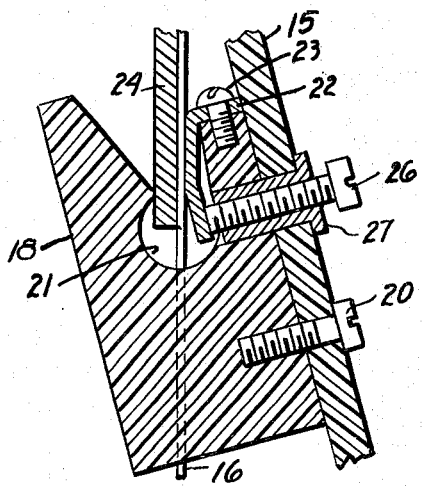
FIG. 7 is an enlarged fragmentary sectional view illustrating the clamp means for the cathode sheet.

A thin, pliable cathode sheet 16 of a suitable electrically conductive material which is not adversely affected by the solution, is fitted in cylindrical form around the inner periphery of the tank 14 with its adjacent ends 17 straddling a clamp bracket 18 (FIGS. 1, 3 and 7) secured to one of the handle portions 15 of the tank, as by a screw 20.

The cathode sheet 16, which is initially in flat rectangular form, may be on the order of 0.010 inches to 0.030 inches in thickness, so that it may be readily flexed to fit within the inner cylindrical surface of the tank and thus cover the major portion of the area thereof.

It has been found that a sheet of silver-coated plastic or a silver-coated wire mesh screen may be used with equal effectiveness as the cathode. Such materials are relatively inexpensive and disposable. Thus, when a sufficient amount of silver has been built up on the cathode sheet, the cathode with its deposited silver may be removed, in toto, and sent to a smelting plant for refinement of the silver. The bracket 18 has an opening 21 therein to receive a spring clamp tab 22 which extends across the adjacent ends 17 of the cathode sheet 16 and is attached at its upper end to the block 18 by a screw 23.

When the lid unit 12 is in place, a conductor bar 24 carried thereby fits into the opening 21 in bracket 18, and bears against the adjacent ends 17 of the cathode sheet on the opposite side of the sheet from that in contact with the tab 22.

For the purpose of removably anchoring the cathode sheet 16 within the tank 14 and for establishing an electrical connection between the cathode sheet and the conductor bar 24, a clamp screw 26 is threaded in a bushing 27 suitably secured in the block 18 and is accessible from the exterior of the tank. Thus, after the lid unit 12 is mounted on the tank unit 11, the clamp screw 26 is advanced to force the cathode sheet 16 into intimate contact with the conductor bar 24.

To install the cathode sheet 16, it is preferably flexed into a generally cylindrical form and then slipped into the tank 11 and allowed to expand against the inner periphery of the tank. The lower end of the cathode sheet 16 rests on an outer flange 27 formed on an annular anode centering cone member 28 which rests on the bottom of the tank.

The tank 14 has an outwardly flaring rim 30 at its upper end which extends adjacent a flange 31 on a lid 32 forming part of the lid unit 12. Lid 32 is also preferably formed of polypropylene or other suitable plastic, and has an annular depending flange 33 which fits within the upper end of the tank.

Figure 2:
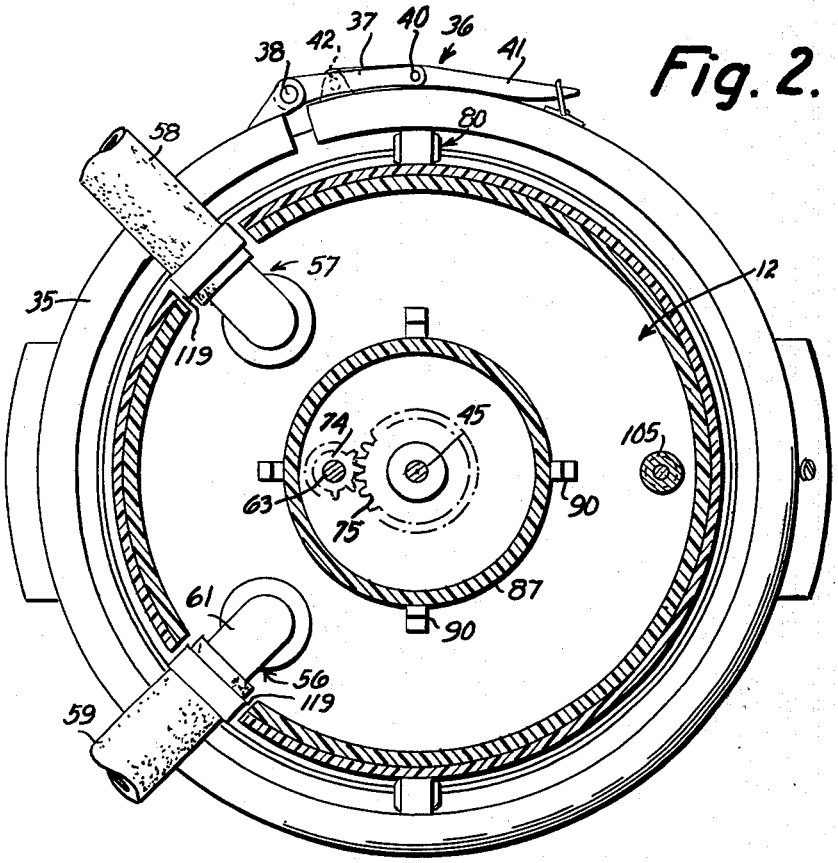
FIG. 2 is a sectional plan view taken substantially along line 2—2 of FIG. 1.
Figure 4:
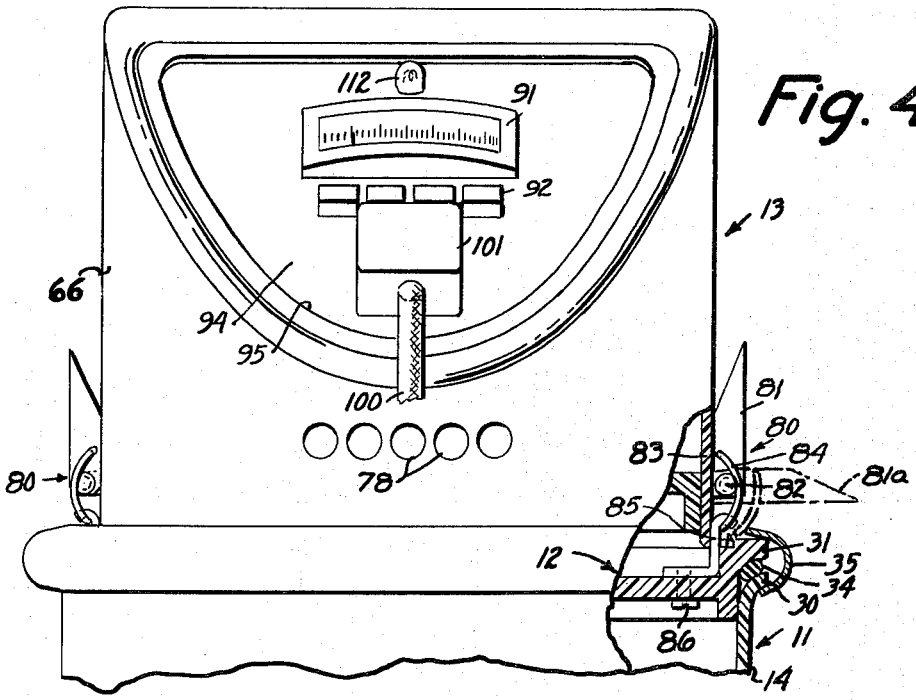
FIG. 4 is a front view, partly in section, showing principally the power unit, taken in the direction of the arrow 4 in FIG. 1.

An O-ring 34 of neoprene or similar elastomeric material impervious to the solution within the tank is fitted around the outer periphery of the lid 32 so as to hermetically seal the tank unit when the lid is clamped thereto. For this purpose, a rim clamp 35 (FIGS. 1, 2 and 4) is provided, comprising a split metal band of C-shaped cross section which is fitted over the flanges 30 and 31. A quick-disconnect toggle lock 36 of conventional design is provided to contract the band of rim clamp 35 and thus clamp the lid unit in hermetically sealed relation to the tank unit 11. The lock comprises a link 37 pivoted at 38 to one end of the band and pivoted at 40 to a toggle lever 41, which in turn is pivoted at 42 to the opposite end of said band.

Figure 5:
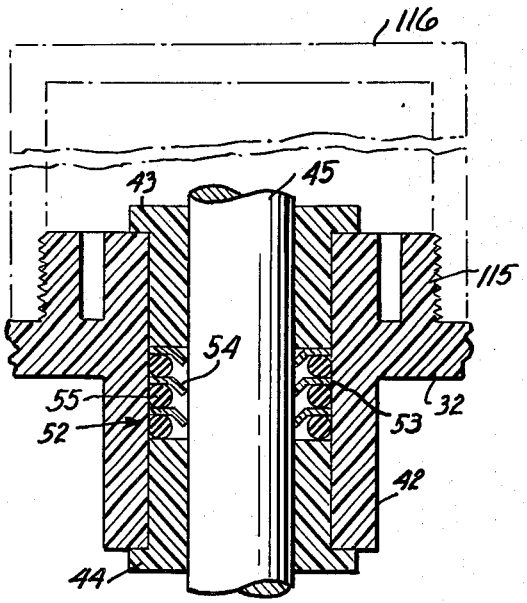
FIG. 5 is an enlarged fragmentary sectional view of a bearing for supporting the anode assembly.

A hollow central hub 42 (FIGS. 1 and 5) is formed on lid 32 to receive two bearing bushings 43 and 44 of nylon or similar plastic, which are suitably secured therein. Bushings 43 and 44 form a bearing for rotatably supporting a Series 316 stainless steel shaft 45 which carries an anode assembly 46 within the tank. The latter comprises a set of four equiangularly spaced rectangular anode bars 47 preferably formed of carbon or other electrically conductive material which will withstand the corrosive solution within the tank as well as the electrolytic action.

The anodes 47 form paddles to effect a general circulation of the solution over the cathode sheet 16. Anodes 47 are supported adjacent the cathode sheet 16 but spaced therefrom sufficiently to allow a build-up of silver. For this purpose, the anodes are mounted on vertically spaced spiders 48 and 50 of conductive material, such as stainless steel. The latter are attached to hubs 51 mounted on shaft 45 and suitably secured thereto.

Means are provided to prevent leakage of the solution along the shaft 45 and through the bearing bushing 43 during rotation of the anode assembly. For this purpose, a seal generally indicated at 52 (FIG. 5) is interposed between the bearing bushings 43 and 44. This seal comprises a set of three thin annular discs 53 which are formed of a modified tetrafluoroethylene material, commercially available from the Dixon Company, under the tradename RULON J. Each disc 53 has a thickness on the order of 0.030 inches and has a dished or generally frusto-conical formation 54 adjacent an inner periphery which is stretched around the shaft 45 to form a ring seal. O-rings 55 of suitable elastomeric material, such as neoprene, are interposed between the discs and the assembly is compressed between the bushings 43 and 44 to prevent leakage of the solution along the bore of the hub 42. The flexible conical formations 54 effectively seal the fluid solution from traveling along the rotating shaft and yet do not appreciably wear the relatively soft stainless steel shaft.

Figure 6:
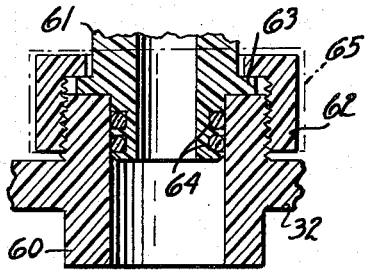
FIG. 6 is an enlarged fragmentary sectional view of one of the fluid connections for the photographic processing solution.

Fluid inlet and outlet connections 56 and 57 (FIGS. 1 and 2) are mounted on the lid 32 to transmit the photographic processing solution to and from the tank 11. Normally, such solution is conducted under a relatively light gravity pressure from the photographic processing equipment (not shown) through a flexible hose 59 to one of the fluid connections which serves as an inlet to the tank. The solution is allowed to freely overflow from the tank through a second flexible hose 58 attached to the other fluid connection, which serves as the outlet. The inlet and outlet fluid connections are identical and, as shown in detail in FIG. 6, each comprises a hollow hub 60 formed on the lid 32. A hollow plastic elbow 61 to which the flexible inlet or outlet hose is connected, is inserted in the bore of the hub, and is held in place by an annular nut 62 which is screw-threaded on an upstanding portion of the hub to press against an annular flange 63 formed on the elbow. A pair of O-rings 64 of elastomeric material are mounted in grooves formed in the lower end of the elbow 61 to seal against fluid leakage. This construction permits quick disconnection of the inlet and outlet hoses, and when they are disconnected a suitable screw cap, indicated by dot-dash lines 65 in FIG. 6, may be threaded over the hub to prevent leakage of the solution during handling or transporting of the tank and lid assembly.

The power unit 13 (FIGS. 1 and 4) comprises a plastic bonnet 66 having an outwardly flared flange 67 at its lower end which rests on the upper surface of lid flange 31. A base 68, also of plastic, is suitably secured within the bonnet and supports a drive unit generally indicated at 70 in FIG. 1. The latter comprises an electric motor 71 which is mounted on and drives a reduction gear unit 72 suitably secured to the base 68. The output shaft of the gear unit, shown at 63, carries a gear 74 which drives a gear 75 attached to the upper end of the anode shaft 45. A fan 76 is mounted on a shaft 77 of the motor 71 to circulate cooling air through suitable openings 78 in the bonnet 66 and upwardly over the motor 71.

Diametrically opposed quick-disconnect clamps 80 (FIGS. 2 and 4) are provided to removably attach the power unit 13 to the lid 32. Each clamp comprises a lock lever 81 pivoted at 82 to the bonnet 66 and pivoted as shown at 83 to the upper, free ends of a U-shaped wire link 84 which straddles the lock lever in the manner illustrated in FIG. 2. The lower, enclosed end of the wire link 84 is interlocked with the upper end of a bracket 85 which is secured by a screw 86 to the lid 32. Swinging the lock lever 81 into the dot-dash line position shown at 81*a* causes pivot 83 to pass over center to release the wire link 84 from the bracket 85 so that the power unit may be removed.

Means are provided to accurately center the power unit 13 on the lid 32, to insure proper mating of the gears 74 and 75, when the power unit is in place. For this purpose, an annular flange 87 (FIGS. 1 and 2) depends from the base 68 and fits within centering bosses 90 upstanding from the lid 32.

The power unit 13 also carries elements of a power supply circuit for applying a direct current to the anode and cathode elements when the power unit is attached. Included in this circuit are an ammeter 91, current control switches 92 and a transformer and rectifier unit 93. The ammeter 91 and switches 92 are mounted on a plastic panel 94 located in an opening 95 in the bonnet 66. One terminal of the rectifying unit 93 is connected by a conductor 99 to a contact leaf spring 96 which is attached at 97 to the base 68 and is maintained in wiping engagement, at its free end, with the upper end of the anode shaft 45 to establish an electrical connection to the anodes 47.

Alternating current is conducted to the power unit 13 by a conventional flexible conductor cord 100 which is provided with a socket 101 removably connected to an electrical plug 102 suitably mounted on the panel 94. One terminal of the plug 102 is connected by a conductor 103 to a terminal formed by a bolt 104 which secures an electric member 105 to the underside of the base 68. When the power unit 13 is in place, spring fingers 109 on the socket member 105 fit in electrical contact with a plug member 106 which is electrically connected to the cathode conductor bar 24 by a bolt 107 passing through the lid 32.

Means are provided to indicate when the apparatus is in operation. For this purpose, a normally open microswitch 108 is mounted over the motor fan 76 and has an air vane 110 pivoted thereon at 111. When the motor 71 is in operation, air drawn upwardly by the fan 76 will force the vane 110 upwardly to close the microswitch 108, to complete a circuit to an indicating lamp 112 mounted on the panel 94.

Other appropriate electrical apparatus may be mounted on the power unit 13. For example, a timer, generally indicated at 113, may be attached to the upper end of the bonnet 66 and electrically connected to the power supply circuit to render the circuit operative only during certain time periods.

It will be noted that when the power unit 13 is properly mounted on the lide 32, the socket 105 will fit over the plug 106 and thus orient the power unit as well as establish electrical contact of the same with the cathode. Also, the leaf contact 96 will directly engage the upper end of the anode shaft 45 to establish electrical contact with the anodes 47. In addition, openings 119 in the bonnet 66 will register with the inlet and outlet fluid connections 56 and 57.

When the lid unit 12 is being mounted on the tank 14, the lower end of the anode shaft 45 is guided centrally of the tank by the centering cone member 28 and finally the depending flange 33 will center the id unit 12 in place.

A threaded hub 115 (FIG. 5) surrounds the hub 42 on lid 32 to receive a protective cap, shown in dot-dash lines 116, to protect the gear 75 when the tank and lid assembly with the power unit 13 removed is being handled or transported.

It will be noted that the floor of lid 32 is depressed below its outer flange 31, so that any solution which may overflow during disconnection of the fluid connections 56 and 57 will be trapped by the lid 32 and thus prevented from spilling over the sides of the tank and onto the floor.

While this disclosure has emphasized the use of our novel apparatus for the recovery of silver from spent photographic processing solutions, it should be understood that the apparatus is not necessarily limited to this use, and can be employed in any other application for which its unique design suits it.

What we claim is:

1. Apparatus for electrolytically recovering silver from a photographic processing solution or the like, comprising:

a tank for receiving said solution;

a thin pliable cathode sheet adapted to extend around the inner periphery of said tank for immersion in said solution;

an anode;

a removable lid supporting said anode for immersion in said solution;

means supported by said lid for moving said anode relative to said cathode sheet to thereby circulate said solution over said cathode sheet; and means for connecting an electric power circuit to said anode and said cathode sheet;

said apparatus serving to bring about the deposition of silver from said solution onto said cathode, and said cathode being of such heat-destructible character that when it has a load of deposited silver it can be placed directly into a silver refining furnace without harm to the purity of the silver melt therein, whereby the deposited silver can be refined without first removing it from said cathode.

2. Apparatus as defined in claim 1, wherein said cathode sheet is a sheet of silver-coated plastic screen on the order of 0.010 inches to 0.030 inches thick and is adapted to flex outwardly into engagement with said inner periphery of said tank when placed therein.

3. Apparatus as defined in claim 1, including;

motor means supportable by said lid for moving said anode about said axis.

4. Apparatus as defined in claim 3, comprising quick-disconnect lock means for attaching said lid to said tank and quick-disconnect lock means for attaching said motor means to said lid.

5. Apparatus as defined in claim 4, comprising an electrical conductor supported by said lid; and clamp means supported by said tank for attaching said cathode sheet to said conductor.

6. Apparatus as defined in claim 5, wherein said clamp means is effective to clamp the ends of said cathode sheet to said conductor in closely spaced relationship.

7. Apparatus as defined in claim 5, wherein said clamp means is adjustable from the interior of said tank for clamping said cathode sheet to said conductor.

8. Apparatus for electrolytically recovering silver from a photographic processing solution or the like comprising:

a tank for receiving said solution;

a cathode adapted to extend around the inner periphery of said tank for immersion in said solution;

a lid removably mountable on said tank;

an anode;

means on said lid supporting said anode for immersion in said solution and for rotation about an axis;

a power unit removably mountable on said lid;

a motor carried by said power unit; and means operatively connecting said motor to said anode when said power unit is mounted on said lid and for disconnecting said motor from said anode when said power unit is removed from said lid.

9. Apparatus as defined in claim 8, including electric power transmitting means carried by said power unit; and means for connecting said power transmitting means to said cathode when said power unit is mounted on said lid and for disconnecting said power transmitting means from said cathode when said power unit is removed from said lid.

10. Apparatus as defined in claim 8, including electric power transmitting means carried by said power unit; and means for connecting said power transmitting means to said anode when said power unit is mounted on said lid, and for disconnecting said power transmitting means from said anode when said power unit is removed from said lid.

11. Apparatus as defined in claim 8, including electric power transmitting means carried by said power unit; and means for connecting said power transmitting means to said anode and to said cathode when said power unit is mounted on said lid and for disconnecting said power transmitting means from said anode and from said cathode when said power unit is removed from said lid.

12. Apparatus as defined in claim 9 wherein said power transmitting means properly orients said power unit relative to said lid when said power unit is mounted on said lid.

13. Apparatus as defined in claim 8 wherein the inner periphery of said tank extends concentrically of said axis when said lid is mounted on said tank and said cathode extends in contact with said inner periphery of said tank.

14. Apparatus as defined in claim 8 wherein said means operatively connecting said motor to said anode comprises a first gear on said power unit driven by said motor and a second gear on said lid connected to said anode, said second gear being driven by said first gear when said power unit is on said lid.

15. Apparatus as defined in claim 8 wherein said anode is connected to a rotatable shaft;

means on said lid form a bearing supporting said shaft for rotation;

electric power transmitting means is carried by said power unit; and yieldable electric contact means is connected to said power transmitting means, said contact means engaging said shaft to thereby electrically connect said anode to said power transmitting means when said power unit is on said lid.

16. Apparatus as defined in claim 8 comprising a cooling fan operable by said motor and an air-responsive device in the path of air driven by said fan for indicating operation of said motor.

17. Apparatus for electrolytically recovering silver from a photographic processing solution or the like comprising a tank for receiving said solution;

a cathode electrode supportable in said tank;

an anode electrode supportable in said tank;

a lid removably mountable on said tank;

a shaft supporting one of said electrodes for rotation relative to the other of said electrodes;

means on said lid forming a bearing for rotatably supporting said shaft;

a seal for preventing said solution from passing through said bearing, said seal comprising a thin annular disc of suitable plastic material, said disc having a dished center portion stretched around said shaft; and means for sealing the outer portion of said disc.

18. Apparatus as defined in claim 17 wherein said bearing comprises two aligned bearing parts; and means including said bearing parts for compressing the outer portions of said disc.

* * * * *